US010192481B2

(12) United States Patent
Cho et al.

(10) Patent No.: US 10,192,481 B2
(45) Date of Patent: Jan. 29, 2019

(54) PIXEL CIRCUIT AND DRIVING METHOD THEREOF, AND ORGANIC LIGHT EMITTING DISPLAY

(71) Applicants: Samsung Electronics Co., Ltd., Suwon-si, Gyeonggi-do (KR); Konkuk University Industrial Cooperation Corp., Seoul (KR)

(72) Inventors: Seongho Cho, Gwacheon-si (KR); Jongbaek Seon, Yongin-si (KR); Keechan Park, Seongnam-si (KR); Sangyeon Kim, Seoul (KR); Seungo Kim, Seoul (KR); Jaewon Lee, Seoul (KR)

(73) Assignees: KONKUK UNIVERSITY INDUSTRIAL COOPERATION CORP. (KR); SAMSUNG ELECTRONICS CO., LTD., Gyeonggi-Do (KR)

( * ) Notice: Subject to any disclaimer, the term of this patent is extended or adjusted under 35 U.S.C. 154(b) by 354 days.

(21) Appl. No.: 15/064,279

(22) Filed: Mar. 8, 2016

(65) Prior Publication Data

US 2016/0379553 A1 Dec. 29, 2016

(30) Foreign Application Priority Data

Jun. 24, 2015 (KR) ..... 10-2015-0089878

(51) Int. Cl.
*G09G 3/36* (2006.01)
*G09G 3/3233* (2016.01)

(52) U.S. Cl.
CPC ..... *G09G 3/3233* (2013.01); *G09G 2300/043* (2013.01); *G09G 2300/0814* (2013.01); *G09G 2300/0819* (2013.01)

(58) Field of Classification Search
CPC .. G09G 3/30; G09G 3/36; G09G 5/00; G09G 3/10; G06F 3/038
See application file for complete search history.

(56) References Cited

U.S. PATENT DOCUMENTS 6,777,888 B2 8/2004 Kondo
7,443,366 B2 10/2008 Choi et al.
(Continued)

FOREIGN PATENT DOCUMENTS

KR 20030073116 A 9/2003
KR 20100071301 A 6/2010
(Continued)

OTHER PUBLICATIONS

Yusuke Onoyama et al., 0.5-inch XGA Micro-OLED Display on a Silicon Backplane with High-Definition Technologies, SID 2012 DIGEST, Sony Corporation, Kanagawa, Japan.

*Primary Examiner* — Pegeman Karimi
(74) *Attorney, Agent, or Firm* — Harness, Dickey & Pierce, PLC

(57) ABSTRACT

Provided are pixel circuits using organic light emitting diodes (OLEDs) and a driving method thereof, and an organic light emitting display including the pixel circuits. The OLED is driven to emit light by a drive transistor generating a drive current compensated with respect to a threshold voltage difference and mobility deviation. The drive transistor may receive reference voltage and data signals in response to separate scan signals supplied to the pixel circuits via different scan lines. As a result, a threshold voltage compensation time, which may include the time during which a reference voltage is supplied to the drive transistor in response to a particular scan signal, may be set long enough regardless of a time during which the data signal is supplied to the pixel circuits located in respective
(Continued)

rows of the organic light emitting display in response to a separate scan signal.

16 Claims, 12 Drawing Sheets

(56) References Cited

U.S. PATENT DOCUMENTS

| | | | | |
|---|---|---|---|---|
| 8,368,618 | B2 | 2/2013 | Choi | |
| 8,830,219 | B2 | 9/2014 | Choi et al. | |
| 2001/0028226 | A1 | 10/2001 | Malaviya et al. | |
| 2009/0159971 | A1 | 6/2009 | Street | |
| 2011/0148949 | A1* | 6/2011 | Matsui | G09G 3/3233 345/690 |
| 2011/0164016 | A1* | 7/2011 | Kang | G09G 3/3233 345/211 |
| 2013/0120228 | A1* | 5/2013 | Yoon | G09G 3/3291 345/80 |
| 2014/0139503 | A1* | 5/2014 | Han | G09G 3/3291 345/212 |
| 2014/0159609 | A1* | 6/2014 | Xie | H01L 27/3265 315/228 |
| 2014/0267468 | A1 | 9/2014 | Lin et al. | |

FOREIGN PATENT DOCUMENTS

| | | | |
|---|---|---|---|
| KR | 20110042616 | A | 4/2011 |
| WO | WO-02/075709 | A1 | 9/2002 |

* cited by examiner

PIXEL CIRCUIT AND DRIVING METHOD THEREOF, AND ORGANIC LIGHT EMITTING DISPLAY

CROSS-REFERENCE TO RELATED APPLICATION

This application claims the priority benefit of Korean Patent Application No. 10-2015-0089878, filed on Jun. 24, 2015, in the Korean Intellectual Property Office, the disclosure of which is incorporated herein in its entirety by reference.

BACKGROUND

1. Field

The present disclosure relates to pixel circuits using organic light emitting diodes (OLEDs) and driving methods thereof, and organic light emitting displays including the pixel circuits.

2. Description of the Related Art

A display may include one or more of liquid crystal displays (LCDs), plasma display panels (PDPs), or field emission displays (FEDs) have been developed, which overcome the disadvantages of cathode ray tubes (CRTs). In some cases, a display may include one or more pixel circuits. The pixel circuits may include a thin film transistor (TFT). In some example embodiments, a pixel circuit may compensate threshold voltage difference of a TFT. In some cases, a reference voltage required for compensating for the threshold voltage difference is transmitted to a pixel circuit through a data line. The reference voltage may be transmitted to one or more pixel circuits in a selected row of pixel circuits. The threshold voltage compensation and data transmission may be finished within a time during which a row is selected.

In some cases, the time during which a row is selected may be an insufficient amount of time for threshold voltage compensation for a display. For example, when a display includes high-resolution organic light emitting diode (OLED) which includes a metal oxide TFT having lower mobility compared to a low temperature polysilicon (LTPS)-TFT is used for compensation, the threshold voltage compensation time may be less than a time duration during which a row is selected.

SUMMARY

Provided are pixel circuits using an organic light emitting diode (OLED) and driving methods thereof, and organic light emitting displays including the pixel circuits.

Additional aspects will be set forth in part in the description which follows and, in part, will be apparent from the description, or may be learned by practice of the presented exemplary embodiments.

According to some example embodiments, a pixel circuit of an organic light emitting display includes a drive control sub-circuit configured to transmit a reference voltage to a drive transistor in response to a first scan signal and transmit a data signal to the drive transistor in response to a second scan signal, a drive sub-circuit including the drive transistor and configured to generate a drive current compensated with respect to a threshold voltage difference and mobility deviation in the drive transistor based on the reference voltage, the data signal, and a power signal, and an OLED configured to emit light based on the drive current.

In some example embodiments, the drive control sub-circuit may be configured to receive each scan signal of the first scan signal and the second scan signal through different scan lines.

In some example embodiments, the drive control sub-circuit may be configured to transmit the reference voltage during a first time segment, the drive control sub-circuit may be configured to transmit the data signal during a second time segment, and the first time segment may be set to be longer in duration than the second time segment.

In some example embodiments, the drive transistor may include a metal oxide thin film transistor (TFT).

In some example embodiments, the drive control sub-circuit may include a first transistor configured to transmit the reference voltage to a gate electrode of the drive transistor in response to the first scan signal, and a second transistor configured to transmit the data signal to the gate electrode of the drive transistor in response to the second scan signal, and the drive sub-circuit may further include a first capacitor configured to be connected between the gate electrode and a source electrode of the drive transistor and store a drive voltage compensated with respect to the threshold voltage difference and mobility deviation in the drive transistor, and a second capacitor connected between the source electrode and a reference voltage line, the reference voltage line configured to carry the reference voltage transmitted by the first transistor, and the drive transistor may be configured to generate the drive current based on the drive voltage.

In some example embodiments, the first capacitor may be configured to store a threshold voltage of the drive transistor based on the reference voltage and the power signal, wherein the reference voltage transmitted by the first transistor during a first time segment.

In some example embodiments, the gate electrode may be configured to change voltage in response to the data signal being transmitted by the second transistor to the gate electrode, wherein the data signal is transmitted by the second transistor during a second time segment, the first capacitor may be configured to store the drive voltage based on the stored threshold voltage, the voltage change of the gate electrode, a voltage distribution between the first and second capacitors, and a voltage change of the source electrode due to mobility deviation in the drive transistor.

According to some example embodiments, an organic light emitting display may include a scan driver configured to provide a first scan signal to a first scan line, the scan driver further configured to provide a second scan signal to a second scan line, a data driver configured to provide a data signal to a data line, a power driver configured to provide a reference voltage to a reference voltage line, the power driver further configured to provide a power signal to a power line, and a plurality of pixel circuits arranged on a position where the first scan line and the data line cross, in which one or more of the pixel circuits may include a drive control sub-circuit configured to transmit the reference voltage to a drive transistor in response to the first scan signal and transmit the data signal to the drive transistor in response to the second scan signal, a drive sub-circuit including the drive transistor and configured to generate a drive current compensated with respect to a threshold voltage difference and mobility deviation in the drive transistor based on the reference voltage, the data signal, and the power signal, and an organic light emitting diode (OLED) configured to emit light based on the drive current.

In some example embodiments, the drive control sub-circuit may be configured to transmit the reference voltage during a first time segment, the drive control sub-circuit may be configured to transmit the data signal during a second time segment, and the first time segment may be set to be longer in duration than the second time segment.

In some example embodiments, the drive transistor may include a metal oxide TFT.

In some example embodiments, the plurality of pixel circuits may include a first pixel circuit and a second pixel circuit, the first pixel circuit and the second pixel circuit located in respective rows of pixel circuits, the scan driver may be configured to transmit the first scan signal to the first pixel circuit, such that a drive control sub-circuit included in the first pixel circuit transmits the reference voltage to a drive transistor included in the first pixel circuit, during a first time segment, the scan driver may be further configured to transmit the second scan signal to the second pixel circuit, such that a drive control sub-circuit included in the second pixel circuit transmits the data signal to a drive transistor included in the second pixel circuit, during a second time segment, and the first time segment and the second time segment may progress at least partially concurrently.

In some example embodiments, the drive control sub-circuit may include a first transistor configured to transmit the reference voltage to a gate electrode of the drive transistor in response to the first scan signal, a second transistor configured to transmit the data signal to the gate electrode of the drive transistor in response to the second scan signal, the drive sub-circuit further may further include a first capacitor configured to be connected between the gate electrode and a source electrode of the drive transistor, the first capacitor further configured to store a drive voltage compensated with respect to the threshold voltage difference and mobility deviation in the drive transistor, and a second capacitor connected between the source electrode and a reference voltage line, the reference voltage line configured to carry the reference voltage transmitted by the first transistor; and the drive transistor is configured to generate the drive current based on the drive voltage.

According to some example embodiments, a method of driving a pixel circuit may include storing a threshold voltage of a drive transistor, based on a power signal transmitted to the drive transistor and a reference voltage transmitted to the drive transistor, the reference voltage transmitted in response to a first scan signal, storing a drive voltage compensated with respect to a threshold voltage difference and mobility deviation in the drive transistor, based on the stored threshold voltage and a data signal transmitted to the drive transistor, the data signal transmitted in response to a second scan signal, and generating a drive current to cause an organic light emitting diode (OLED) to emit light through the drive current, the drive current corresponding to the drive voltage.

In some example embodiments, the storing of the threshold voltage may store the threshold voltage of the drive transistor based on a voltage change of the power signal and the reference voltage transmitted during a first time segment, and the storing of the drive voltage may store the drive voltage based on the stored threshold voltage and the data signal transmitted during the second time segment.

According to some example embodiments, an OLED is driven using a drive voltage compensated with respect to the threshold voltage difference and mobility deviation in a drive transistor according to first and second scan signals supplied by different scan lines, respectively.

In some example embodiments, according to some example embodiments, a first time segment that is a threshold voltage compensation time of the drive transistor and a second time segment during which a data signal is transmitted to the drive transistor are separated according to first and second scan signals, and the first time segment may be set to be longer than the second time segment.

In some example embodiments, the first time segment, which is a threshold voltage compensation time, may progress in a pixel circuit located in any one row of a plurality of pixel circuits while the second time segment, during which the data signal is transmitted to a pixel circuit located in another row of the pixel circuits, progresses.

BRIEF DESCRIPTION OF THE DRAWINGS

Example embodiments will be described in more detail with regard to the figures, wherein like reference numerals refer to like parts throughout the various figures unless otherwise specified, and wherein.

Figure 1:
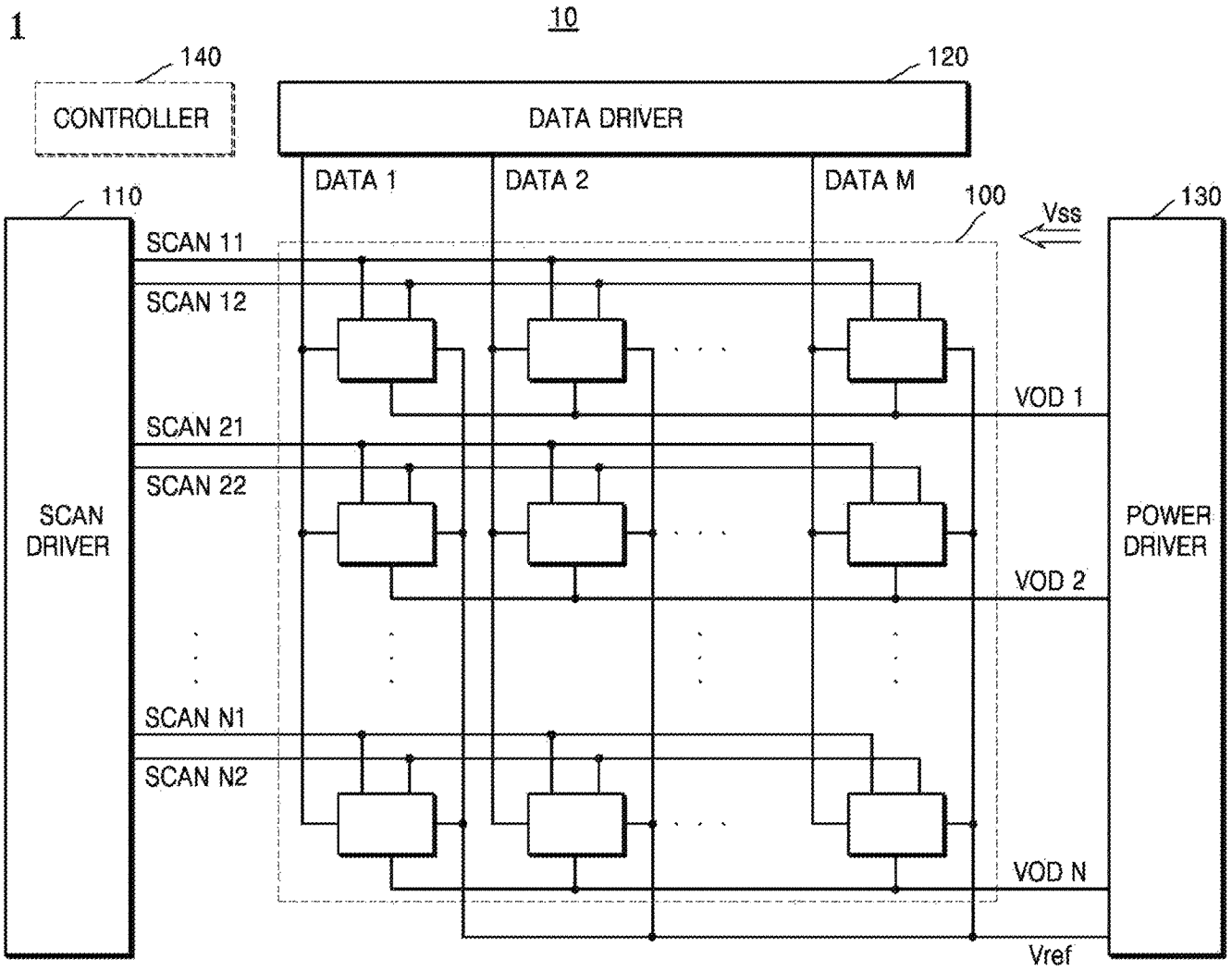
FIG. 1 is a block diagram of an organic light emitting display according to some example embodiments.

It should be noted that these figures are intended to illustrate the general characteristics of methods and/or structure utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments.

DETAILED DESCRIPTION

One or more example embodiments will be described in detail with reference to the accompanying drawings. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated.

Although the terms "first," "second," "third," etc., may be used herein to describe various elements, components, regions, layers, and/or sections, these elements, components, regions, layers, and/or sections, should not be limited by these terms. These terms are only used to distinguish one element, component, region, layer, or section, from another region, layer, or section. Thus, a first element, component, region, layer, or section, discussed below may be termed a second element, component, region, layer, or section, without departing from the scope of this disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

As used herein, the singular forms "a," "an," and "the," are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups, thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

Unless otherwise defined, all terms (including technical and scientific terms) used herein have the same meaning as commonly understood by one of ordinary skill in the art to which example embodiments belong. Terms, such as those defined in commonly used dictionaries, should be interpreted as having a meaning that is consistent with their meaning in the context of the relevant art and/or this disclosure, and should not be interpreted in an idealized or overly formal sense unless expressly so defined herein.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as one computer processing device; however, one skilled in the art will appreciate that a hardware device may include multiple processing elements and multiple types of processing elements. For example, a hardware device may include multiple processors or a processor and a controller. In addition, other processing configurations are possible, such as parallel processors.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

FIG. 1 is a block diagram of an organic light emitting display 10 according to some example embodiments.

According to some example embodiments, the organic light emitting display 10 may include a plurality of pixel circuits 100, a scan driver 110, a data driver 120, a power driver 130, and a controller 140. Components only related to some example embodiments are illustrated in the organic light emitting display 10 of FIG. 1. Therefore, a person of ordinary skill in the art to which some example embodiments pertain may understand that other general components other than the components of FIG. 1 may be further included in the organic light emitting display 10.

The organic light emitting display 10 includes an electronic device configured to display one or more images. The electronic device may include one or more of, for example, a smart phone, a tablet personal computer (PC), a laptop computer, a monitor, or a television, and a component for displaying an image of the electronic device.

Figure 2:
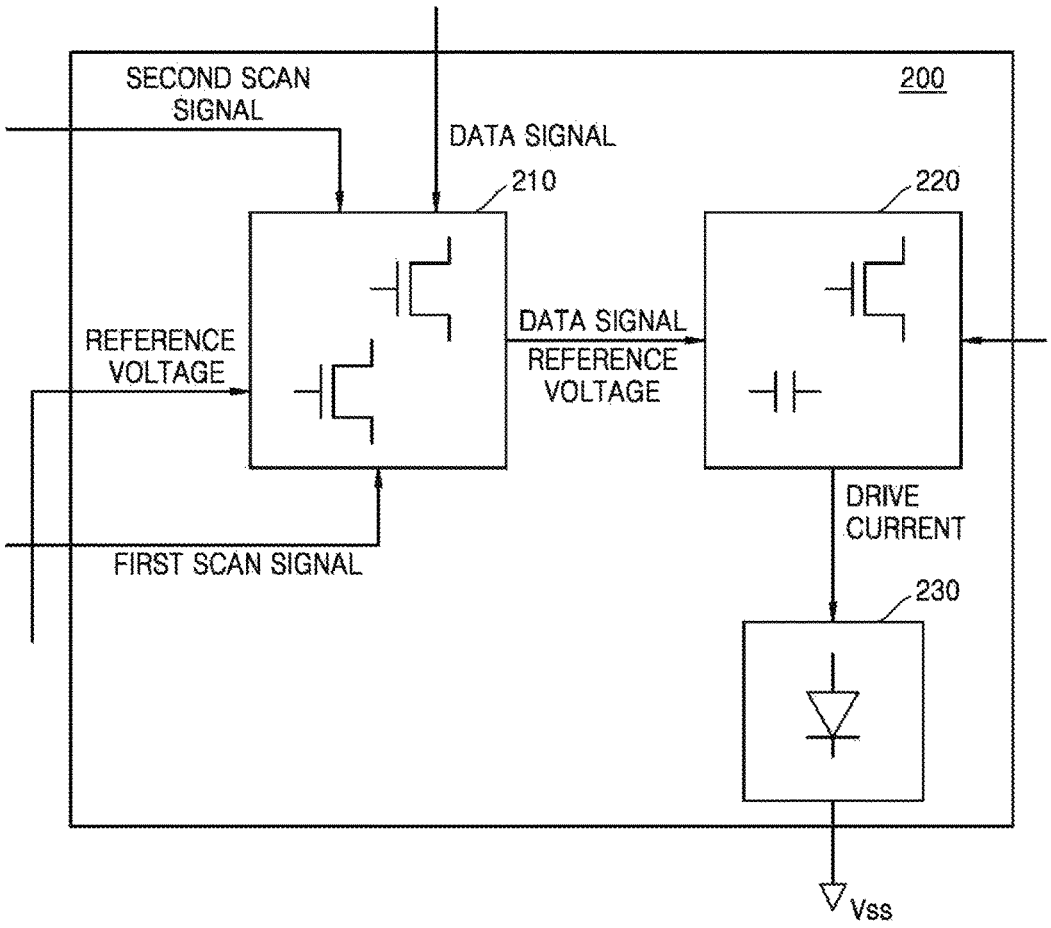
FIG. 2 is a view of a pixel circuit according to some example embodiments.
Figure 3:
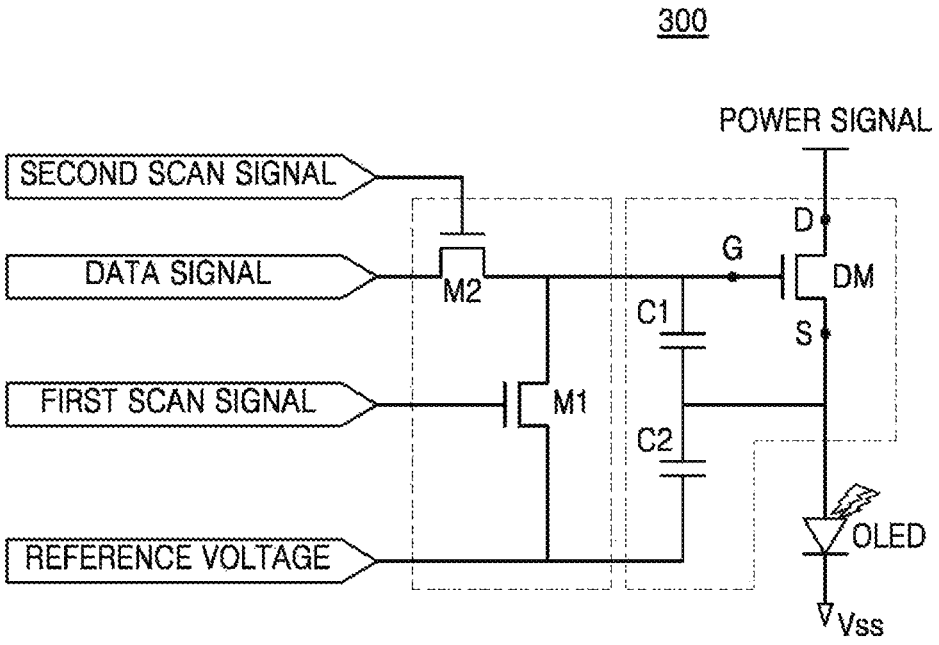
FIG. 3 is a view of a pixel circuit according to some example embodiments.

The pixel circuits 100 may be arranged in an N×M matrix (where, N and M are natural numbers) according to some example embodiments, and each of the pixel circuits 100 may correspond to a pixel circuit 200 of FIG. 2 and a pixel circuit 300 of FIG. 3.

According to some example embodiments, the scan driver 110 may generate a first scan signal SCAN N1 and a second scan signal SCAN N2, and respectively provide the first scan signal SCAN N1 and the second scan signal SCAN N2 to the pixel circuits 100 through first and second scan lines. Each of the first scan lines providing the first scan signal SCAN N1 and each of the second scan lines providing the second scan signal SCAN N2 may be connected to pixel circuits located in a same row from among the pixel circuits 100. The first scan signal SCAN N1 and the second scan signal SCAN N2 may be sequentially driven in units of rows. In some embodiments, the first scan signal SCAN N1 and the second scan signal SCAN N2 can be provided to a given set of pixel circuits 100 during separate, independent time periods, also referred to herein as time segments. As a result, a time segment during which the first scan signal SCAN N1 is provided to a row of pixel circuits may be independent of, and thus longer than a time segment during which the second scan signal SCAN N2 is provided to the given row of pixel circuits. The separate time segments may at least partially overlap.

According to some example embodiments, the data driver 120 may convert digital image data DATA having a gray scale into a data signal DATA M having a gray scale voltage corresponding to the gray scale and provide the data signal DATA M to each of the pixel circuits 100 through data lines. The data driver 120 may generate the data signal DATA M from RGB data by using a gamma filter or a digital-analog converter circuit. The data signal DATA M may be respectively provided to the pixel circuits located in the same row from among the pixel circuits 100 during one scan period. In some example embodiments, each of the data lines providing the data signal DATA M may be connected to the pixel circuits located in the same row.

According to some example embodiments, the power driver 130 may generate a power signal $V_{DD}$ N and provide the power signal $V_{DD}$ N to each of the pixel circuits 100 through power lines. The power lines providing the power signal $V_{DD}$ N may be connected to the pixel circuits located in the same row from among the pixel circuits 100. The power signal $V_{DD}$ N may be sequentially driven in units of rows. In some example embodiments, according to some example embodiments, the power driver 130 may provide a reference voltage $V_{Ref}$ to each of the pixel circuits 100 through reference voltage lines. Moreover, the power driver 130 may provide a predetermined voltage or a power $V_{SS}$ such as a ground voltage to each of the pixel circuits 100.

The controller 140 may receive an image data signal from outside and control the scan driver 110, the data driver 120, and the power driver 130 through control signals.

The scan driver 110, the data driver 120, the power driver 130, and the controller 140 may be formed in respective semiconductor chips or may be integrated in one semiconductor chip. According to some example embodiments, the scan driver 110 may be formed on a substrate on which the pixel circuits 100 are also arranged.

FIG. 2 is a view of the pixel circuit 200 according to some example embodiments.

According to some example embodiments, the pixel circuit 200 may include a drive control sub-circuit 210, drive sub-circuit 220, and an organic light emitting diode (OLED) 230. Components only related to the present exemplary embodiment are illustrated in the pixel circuit 200 of FIG. 2. Therefore, a person of ordinary skill in the art to which the present exemplary embodiment pertains may understand that other general components other than the components of FIG. 2 may be further included in the pixel circuit 200.

According to some example embodiments, the drive control sub-circuit 210 may transmit a reference voltage to the drive sub-circuit 220 in response to a first scan signal, and may transmit a data signal to the drive sub-circuit 220 in response to a second scan signal. In more detail, the drive control sub-circuit 210 may transmit the reference voltage to a drive transistor included in the drive sub-circuit 220 in response to the first scan signal, and may transmit the data signal to a drive transistor included in the drive sub-circuit 220 in response to the second scan signal. According to some example embodiments, the drive control sub-circuit 210 may include a first transistor transmitting the reference voltage to a gate electrode of the drive transistor in response to the first scan signal, and may include a second transistor transmitting the data signal to the gate electrode of the drive transistor in response to the second scan signal.

According to some example embodiments, the drive control sub-circuit 210 may transmit the reference voltage to the drive sub-circuit 220 during a first time segment in response to the first scan signal, and may transmit the data signal to the drive sub-circuit 220 during a second time segment in response to the second scan signal. In some example embodiments, the first time segment may be set to be longer than the second time segment. The first scan signal may be received during the first time segment and the second scan signal may be received during the second time segment. The first scan signal and the second scan signal may be received independently of each other, such that the first time segment and the second time segment are independent of each other. As a result, a duration of one or more of the first time segment may be independent of a duration of the second time segment. The first time segment and the second time segment may have different durations. For example, the first scan signal may be received during a first time segment, where the first time segment begins prior to a second time period during which the second scan signal is received. The first time segment may be longer in duration than the second time period. A duration of a time segment may be associated with a time duration during which an associated scan signal is received. For example, a duration of the first time segment may be based on a duration of time during which the first scan signal is received, and a duration of the second time segment may be based on a duration of time during which the second scan signal is received.

According to some example embodiments, the drive sub-circuit 220 may include the drive transistor and may generate a drive current compensated with respect to a threshold voltage difference and mobility deviation in the drive transistor based on the reference voltage and the data signal transmitted from the drive control sub-circuit 210, and a power signal. According to some example embodiments, the drive transistor may be a metal oxide thin film transistor (TFT).

According to some example embodiments, the drive sub-circuit 220 may store a threshold voltage of the drive transistor based on a voltage change of the power signal and the reference voltage transmitted from the drive control sub-circuit 210 during the first time segment. Next, the drive sub-circuit 220 may store a drive voltage compensated with respect to a threshold voltage difference and mobility deviation in the drive transistor based on the reference voltage already stored in the drive sub-circuit 220 and the data signal transmitted from the drive control sub-circuit 210 during the second time segment, such that the drive sub-circuit 220 stores the drive voltage compensated with respect to the threshold voltage difference and mobility deviation in the drive transistor, in which the threshold voltage difference and mobility deviation in the drive transistor may change according to each pixel circuit 100. In some example embodiments, the drive sub-circuit 220 may generate a drive current corresponding to the stored drive voltage.

According to some example embodiments, the drive sub-circuit 220 may be connected between the gate electrode and a source electrode of the drive transistor, and may include a first capacitor storing the drive voltage. In some example embodiments, the drive sub-circuit 220 may further include a second capacitor connected between the source electrode of the drive transistor and the reference voltage, such that the second capacitor may be connected between the source electrode of the drive transistor and a reference voltage line providing the reference voltage. According to some example embodiments, the drive transistor may generate a drive current based on the drive voltage stored in the first capacitor.

According to some example embodiments, the pixel circuit 200 may correspond to each of the pixel circuits 100 of FIG. 1. The pixel circuit 200 may receive the first scan signal from the scan driver 110 through a first scan line and may receive the second scan signal from the scan driver 110 through a second scan line. The first scan signal and the second scan signal may be received independently of each other, such that the first scan signal and the second scan signal are received during independent time segments. The pixel circuit 200 may receive the data signal from the data lines of the data driver 120. The pixel circuit 200 may receive a power signal from the power lines of the power driver 130, and may receive a reference voltage from the reference voltage lines of the power driver 130, such that the first time segment during which the reference voltage is transmitted to the drive transistor and the second time segment during which the data signal is transmitted to the drive transistor may be spaced apart from each other, according to the reference voltage and the data signal respectively provided to the reference voltage lines and the data lines. The first time segment during which the reference voltage is transmitted may correspond to the first time segment during which the first scan signal is received, as the reference voltage may be transmitted based on the first scan signal being received. The second time segment during which the data signal is transmitted may correspond to the second time segment during which the second scan signal is received, as the data signal may be transmitted based on the second scan signal being received.

In some example embodiments, with respect to first and second pixel circuits respectively located in A row and B row from among the pixel circuits, the second time segment, during which the data signal is transmitted to the drive transistor included in the second pixel circuit based on a second scan signal SCAN B2, may progress independently of the first time segment, during which the reference voltage is transmitted to the drive transistor included in the first pixel circuit based on a first scan signal SCAN A1, progresses, such that the first time segment in the first pixel circuit and the second time segment in the second pixel circuit are separated from each other as the reference voltage and data signal are separately respectively provided to the first and second pixel circuits. In some example embodiments, as the first scan signal SCAN A1 and the second scan signal SCAN B2 are provided by respective scan lines and the first time segment is set to be longer than the second time segment, a threshold voltage compensation time, which is the first time segment, may be set long enough to provide sufficient threshold voltage compensation time for a pixel circuit that includes a given drive transistor, regardless of a second time segment, also referred to herein as a 1H time, during which the data signal is transmitted to the pixel circuits located in respective rows of the organic light emitting display 10. As a result, the first time segment can be set to be sufficient for a threshold voltage separation time for a given display which includes a given drive transistor. In some example embodiments, the first time segment can be set to provide a threshold voltage compensation time that is sufficiently long to enable threshold voltage compensation in a pixel circuit which includes a drive transistor that may be a metal oxide TFT.

The OLED 230 may emit light due to the drive current transmitted from the drive sub-circuit 220, such that the OLED 230 emits light having a brightness proportional to a level of the drive current transmitted from the drive sub-circuit 220.

FIG. 3 is a view of pixel circuit 300 according to some example embodiments.

According to some example embodiments, the pixel circuit 300 may include a first transistor M1, a second transistor M2, a drive transistor DM, a first capacitor C1, a second capacitor C2, and an organic light emitting diode OLED. Components only related to the present exemplary embodiment are illustrated in the pixel circuit 300 of FIG. 3. Therefore, a person of ordinary skill in the art to which the present exemplary embodiment pertains may understand that other general components other than the components of FIG. 3 may be further included in the pixel circuit 300.

According to some example embodiments, the drive control sub-circuit 210 of FIG. 2 may include the first transistor M1 and the second transistor M2. In some example embodiments, the drive sub-circuit 220 of FIG. 2 may include the drive transistor DM, the first capacitor C1, and the second capacitor C2.

According to some example embodiments, the first transistor M1 may transmit a reference voltage to a gate electrode G of the drive transistor DM in response to a first scan signal. According to some example embodiments, a gate electrode of the first transistor M1 may be connected to a first scan line and receive the first scan signal. In some example embodiments, a first electrode of the first transistor M1 may be connected to a second electrode of the second transistor M2 and the gate electrode G of the drive transistor DM. In some example embodiments, a second electrode of the first transistor M1 may be connected to a reference voltage line and receive the reference voltage. According to some example embodiments, the first transistor M1 may transmit the reference voltage to the gate electrode G of the drive transistor DM in response to a voltage rise of the first scan signal, and the first transistor M1 may stop transmission of the reference voltage in response to a voltage drop of the first scan signal, such that the first transistor M1 transmits the reference voltage to the gate electrode G of the drive transistor DM in response to the first scan signal during a first time segment. According to some example embodiments, the first time segment includes a period of time during which the first scan signal is received at the first transistor. According to some example embodiments, the first transistor M1 may be a metal oxide TFT.

According to some example embodiments, the second transistor M2 may transmit a data signal to the gate electrode G of the drive transistor DM in response to a second scan signal. According to some example embodiments, a gate electrode of the second transistor M2 may be connected to a second scan line and receive the second scan signal. In some example embodiments, a first electrode of the second transistor M2 may be connected to a data line and receive the data signal. In some example embodiments, the second electrode of the second transistor M2 may be connected to the first electrode of the first transistor M1 and the gate electrode G of the drive transistor DM. According to some example embodiments, the second transistor M2 may transmit the data signal to the gate electrode G of the drive transistor DM in response to a voltage rise of the second scan signal, and the second transistor M2 may stop transmission of the data signal in response to a voltage drop of the second scan signal, such that the second transistor M2 transmits the data signal to the gate electrode G of the drive transistor DM in response to the second scan signal during a second time segment. According to some example embodiments, the second time segment includes a period of time during which the second scan signal is received at the second transistor. In some example embodiments, the first time segment and the second time segment may be independent of each other in at least one of duration and time of occurrence. In some example embodiments, the first time segment may be set to be longer than a second time segment. In some embodiments, the first time segment may be set to be a duration independent of a duration of the second time segment. The first time segment may be set based on the time period during which the first scan signal is transmitted to the first transistor, and the second time segment may be set based on the time period during which the second scan signal is transmitted to the second transistor. According to some example embodiments, the second transistor M2 may be a metal oxide TFT.

According to some example embodiments, the first capacitor C1 may be connected between the gate electrode G and a source electrode S of the drive transistor DM, such that a first electrode of the first capacitor C1 may be connected to the gate electrode G and a second electrode of the first capacitor C1 may be connected to the source electrode S.

According to some example embodiments, the first capacitor C1 may store a threshold voltage of the drive transistor DM based on a power signal transmitted to the drain electrode D of the drive transistor DM and the reference voltage transmitted to the gate electrode G during the first time segment, such that the threshold voltage of the drive transistor DM, which may different according to each of the pixel circuits 100, is stored in the first capacitor C1. An exemplary embodiment will be described in more detail with respect to FIG. 7.

According to some example embodiments, the first capacitor C1 may store a drive voltage compensated with respect to a threshold voltage difference and mobility deviation in the drive transistor DM based on the threshold voltage already stored in the first capacitor C1 and the data signal transmitted to the gate electrode G during the second time segment following the first time segment. An exemplary embodiment will be described in more detail with respect to FIG. 8.

According to some example embodiments, the second capacitor C2 may be connected between the source electrode S of the drive transistor DM and the reference voltage, such that the second capacitor C2 is connected to the first capacitor C1 in series and a first electrode of the second capacitor C2 may be connected to the second electrode of the first capacitor C1 and the source electrode S of the drive transistor DM. In some example embodiments, a second electrode of the second capacitor C2 may be connected to the reference voltage line and receive the reference voltage.

According to some example embodiments, the drive transistor DM may generate a drive current according to the drive voltage stored in the first capacitor C1, such that the drive transistor DM generates a drive current according to the drive voltage which is a voltage difference between the gate electrode G and the source electrode S and stored in the first capacitor C1. In some example embodiments, the drive transistor DM may generate a drive current compensated with respect to a threshold voltage difference and mobility deviation in the drive transistor DM. According to some example embodiments, the drive transistor DM may be a metal oxide TFT.

The organic light emitting diode OLED may emit light having a brightness proportional to a level of the drive current transmitted from the drive transistor DM. In some example embodiments, a positive electrode of the organic light emitting diode OLED may be connected to the source electrode S of the drive transistor DM and a negative electrode of the organic light emitting diode OLED may be connected to a power $V_{SS}$ which plays a role as a ground voltage.

Hereinafter, it will be described that the pixel circuit 300 of FIG. 3 is driven from a T1 segment to a T5 segment according to some example embodiments.

Figure 4:
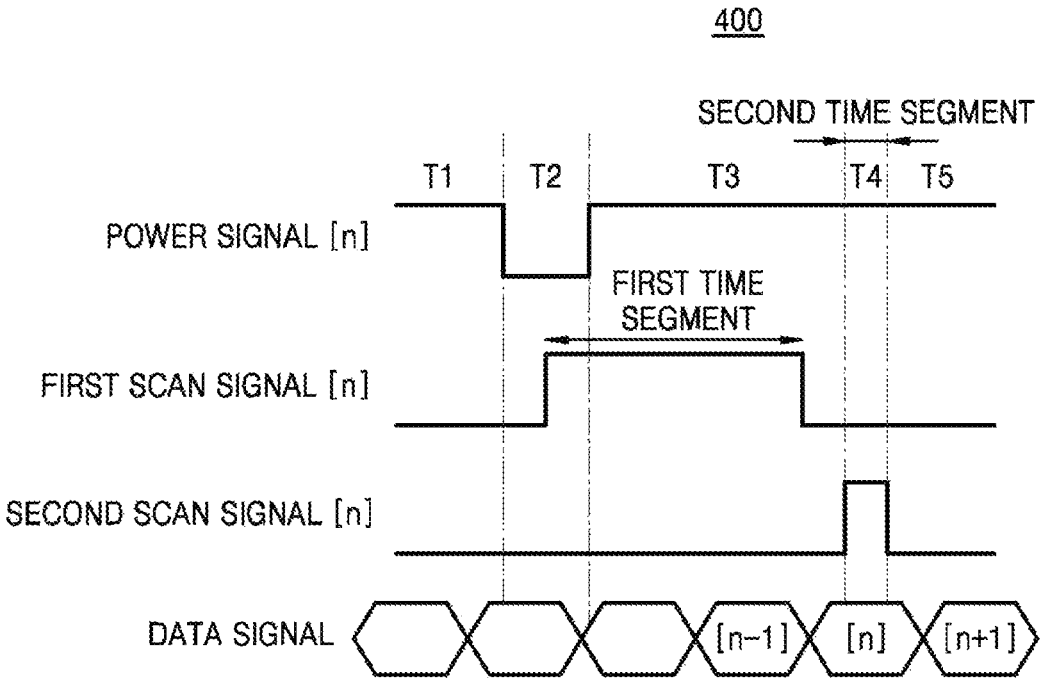
FIG. 4 is a signal waveform chart of driving a pixel circuit according to some example embodiments.

FIG. 4 is a signal waveform chart 400 of driving a pixel circuit 300 according to some example embodiments.

According to some example embodiments, the signal waveform chart 400 describes a waveform chart of a data signal corresponding to pixel circuits in a predetermined mth column from among the pixel circuits 100 of FIG. 1, a waveform chart of a power signal corresponding to pixel circuits in an nth row from among the pixel circuits 100 of FIG. 1, a waveform chart of a first scan signal corresponding to pixel circuits in the nth row, and a waveform chart of a second scan signal corresponding to pixel circuits in the nth row.

Hereinafter, it will be described that the pixel circuit 300 is driven from a T1 segment to a T5 segment according to the signal waveform chart 400, in FIGS. 5 to 10.

Figure 5:
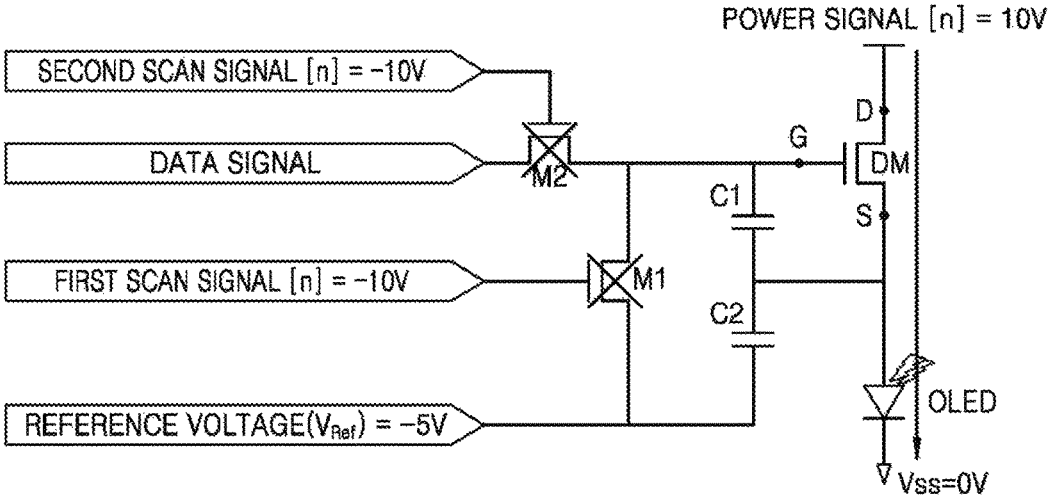
FIG. 5 is a view illustrating the pixel circuit being driven in a T1 segment of the signal waveform chart of FIG. 4.

FIG. 5 is a view illustrating the pixel circuit 300 being driven in the T1 segment of the signal waveform chart 400 of FIG. 4.

According to some example embodiments, a voltage of a power signal [n] may be 10V (volt), voltages of a first scan signal [n] and a second scan signal [n] may respectively be −10V, a voltage of a reference voltage may be −5V, and a voltage of a power $V_{SS}$ may be 0V, in the T1 segment. However, 0V, −5V, and −10V are only examples and the voltages may have other values.

As a first transistor M1 and a second transistor M2 are turned off according to the first scan signal [n] and the second scan signal [n] in the T1 segment, a data signal and a reference voltage may be not transmitted to a gate electrode G of a drive transistor DM.

The drive transistor DM may generate a drive current corresponding to a drive voltage stored in a first capacitor C1 and drive an organic light emitting diode OLED to emit light by using the generated drive current. The first capacitor C1 may store a drive voltage compensated with respect to a threshold voltage difference and mobility deviation in the drive transistor DM according to receiving the data signal in a time segment before the T1 segment. Therefore, the drive transistor DM may drive the organic light emitting diode OLED to emit light through the drive current corresponding to the drive voltage stored in the first capacitor C1.

The T1 segment and the T5 segment of the signal waveform chart 400 may correspond to each other, such that the pixel circuit 300 drives the organic light emitting diode OLED to emit light by using the drive voltage stored in the first capacitor C1 according to change of the signal waveform chart 400 in the time segment before the T1 segment, in the T1 segment. In some example embodiments, the pixel circuit 300 may drive the organic light emitting diode OLED to emit light by using the drive voltage stored in the first capacitor C1 according to change of the signal waveform chart 400 from the T2 segment to the T4 segment, in the T5 segment.

Figure 6:
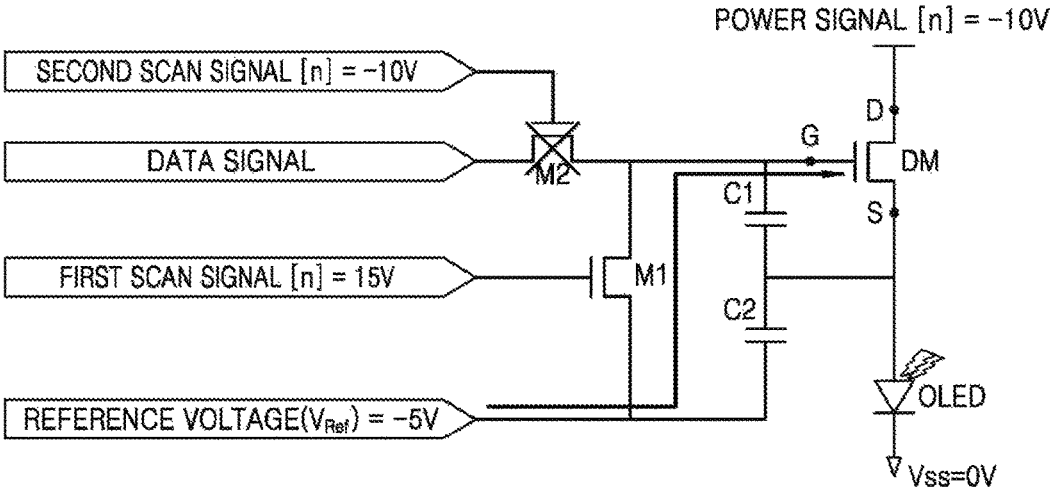
FIG. 6 is a view illustrating the pixel circuit being driven in a T2 segment of the signal waveform chart of FIG. 4.

FIG. 6 is a view illustrating the pixel circuit 300 being driven in the T2 segment of the signal waveform chart 400 of FIG. 4.

According to some example embodiments, a voltage of the power signal [n] may drop from 10V to −10V and a voltage of the first scan signal [n] may increase from −10V to 15V in the T2 segment following the T1 segment. However, 10V, 15V, and −10V are only examples and the voltages may have other values.

The first transistor M1 may be turned on as the voltage of the first scan signal [n] becomes higher and a reference voltage −5V may be transmitted to the gate electrode G of the drive transistor DM. Next, the drive transistor DM may be turned on and a voltage of the source electrode S may be lower as the power signal [n] is connected to the source electrode S.

Figure 7:
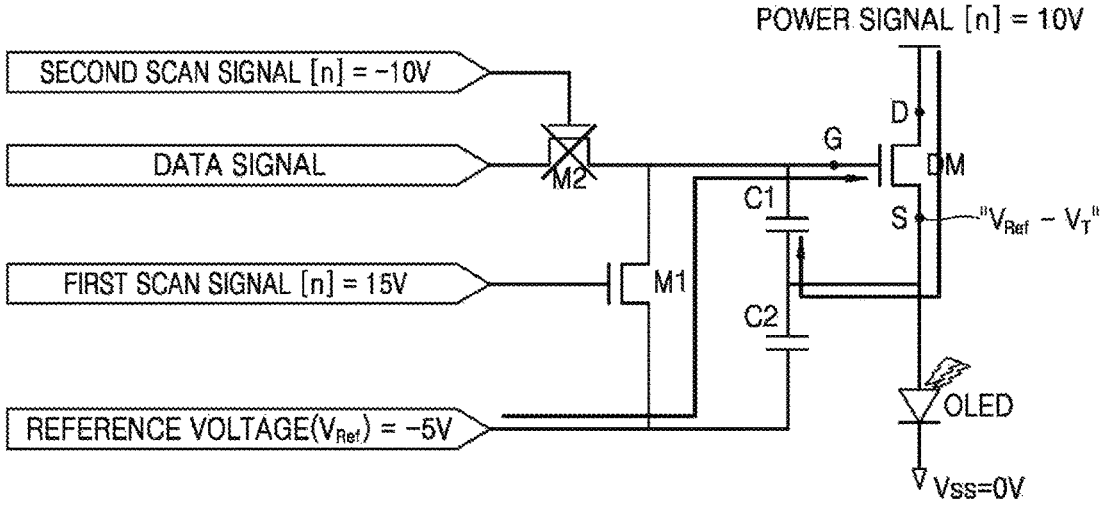
FIG. 7 is a view illustrating the pixel circuit being driven in a T3 segment of the signal waveform chart of FIG. 4.

FIG. 7 is a view illustrating the pixel circuit 300 driving in a T3 segment of the signal waveform chart 400 of FIG. 4.

According to some example embodiments, a voltage of the power signal [n] may increase from −10V to 10V and a voltage of the first scan signal [n] may drop from 15V to −10V in the T3 segment following the T2 segment. However, 15V, 10V, and −10V are only examples and the voltages may have other values.

As the voltage of the power signal [n] becomes higher, a current may flow in a direction of the source electrode S in the power signal [n] and a voltage of the source electrode S or a second electrode of the first capacitor C1 becomes higher. When the voltage of the source electrode S or the second electrode of the first capacitor C1 reaches (a reference voltage $V_{Ref}$—a threshold voltage $V_T$ of the drive transistor DM) after rising, a current may rarely flow in the drive transistor DM. Next, the first transistor M1 may be turned off as the voltage of the first scan signal [n] becomes lower. Therefore, the first capacitor C1 may store a threshold voltage $V_T$ of the drive transistor DM, which is a voltage between the gate electrode G and the source electrode S, such that the first capacitor C1 stores the threshold voltage $V_T$ of the drive transistor DM by a process of compensating for a threshold voltage deviation of the drive transistor DM in the T4 and T5 segments.

Therefore, an organic light emitting display including the pixel circuit 300 may adjust a storage time of the threshold voltage $V_T$ in the first capacitor C1 by adjusting a length of a first time segment during which the reference voltage is transmitted to the gate electrode G as the voltage of the first scan signal [n] becomes higher.

Figure 8:
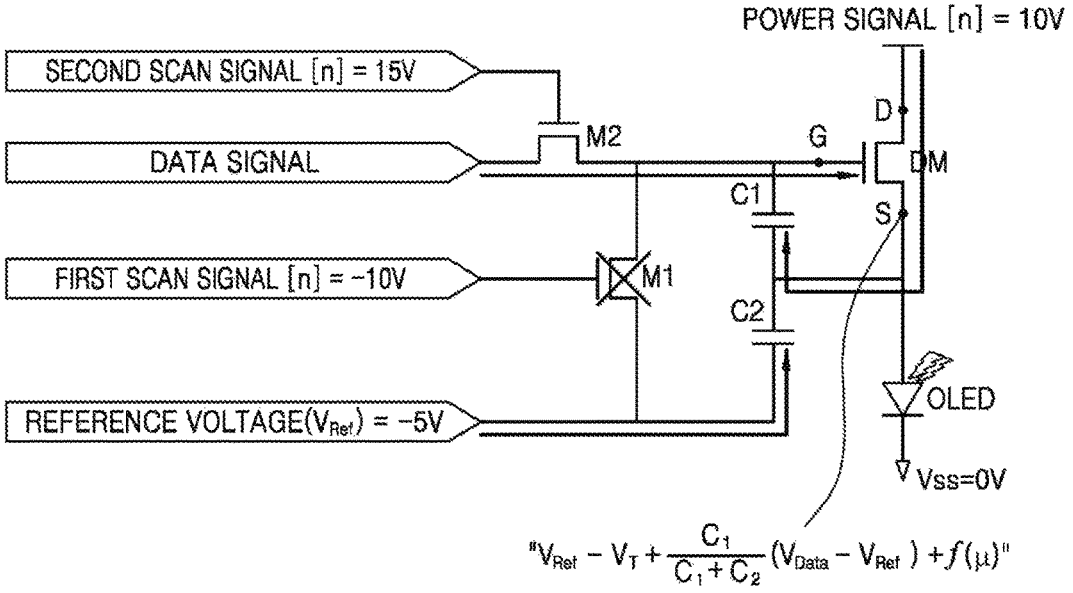
FIG. 8 is a view illustrating the pixel circuit being driven in a T4 segment of the signal waveform chart of FIG. 4.

FIG. 8 is a view illustrating the pixel circuit 300 driving in a T4 segment of the signal waveform chart 400 of FIG. 4.

According to some example embodiments, a voltage of a second scan signal [n] may increase from 10V to 15V and may drop again from 15V to −10V in the T4 segment following the T3 segment. However, 15V, 10V, and −10V are only examples and the voltages may have other values.

The second transistor M2 may be turned on as the voltage of the second scan signal [n] becomes higher and a data signal may be transmitted to the gate electrode G of the drive transistor DM.

A voltage of the gate electrode G changes from $V_{Ref}$ to $V_{Data}$ as a voltage $V_{Data}$ of the data signal is transmitted to the gate electrode G, and a voltage of the source electrode S may become $(c1/(c1+c2))\times(V_{Data}-V_{Ref})+V_{Ref}-V_T$ by coupling effect of the first capacitor C1 (c1 represents a capacitance of the first capacitor C1, and c2 represents a capacitance of the second capacitor C2), such that a voltage distribution is performed between the first capacitor C1 and the second capacitor C2 connected in series due to a voltage change of a first electrode of the first capacitor C1 connected to the gate electrode G, and thus a voltage of a second electrode of the first capacitor C1 connected to the source electrode S may be determined. An exemplary embodiment will be described in more detail with respect to FIG. 9.

Figure 9:
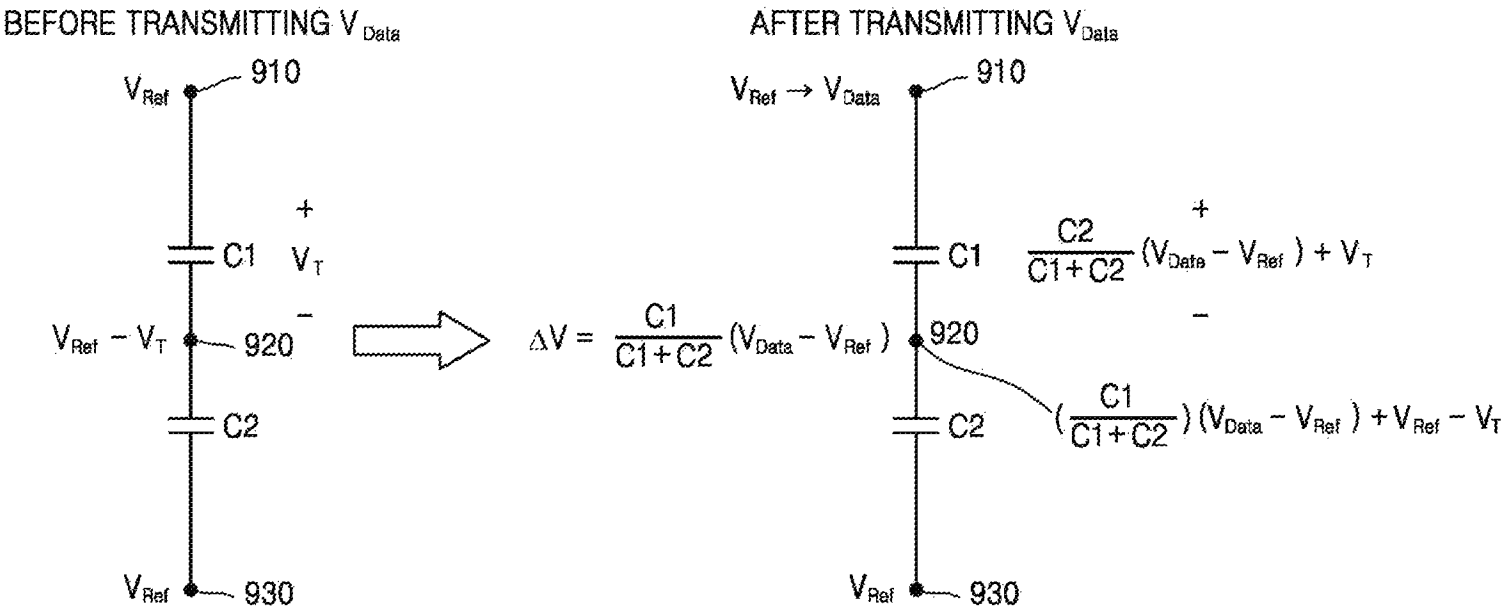
FIG. 9 is a view illustrating a voltage change of a source electrode in a drive transistor due to a transmission of a data signal according to some example embodiments.

FIG. 9 is a view illustrating a voltage change of the source electrode S in the drive transistor DM due to a transmission of a data signal according to some example embodiments.

A voltage change of a first electrode 910 of the first capacitor C1 may be $V_{Data}-V_{Ref}$ as the voltage $V_{Data}$ of the data signal is transmitted to the gate electrode G. Since a voltage of a second electrode 930 of the second capacitor C2 is maintained as $V_{Ref}$, a voltage change of the second electrode 920 of the first capacitor C1 or the source electrode S of the drive transistor DM becomes $(c1/(c1+c2))\times(V_{Data}-V_{Ref})$ according to the voltage change of the first electrode 910 and a voltage distribution between the first capacitor C1 and the second capacitor C2 connected in series. Therefore, the voltage of the second electrode 920 or the source electrode S may be $(c1/(c1+c2))\times(V_{Data}-V_{Ref})+V_{Ref}-V_T$, and a voltage between the gate electrode G and the source electrode S of the drive transistor DM may be $(c2/(c1+c2))\times(V_{Data}-V_{Ref})+V_T$.

A current flowing in the drive transistor DM of FIG. 8 may vary according to mobility deviation of the drive transistor DM. In some example embodiments, a current flowing in a drive transistor of each of the pixel circuits 100 may vary according to mobility deviation of the drive transistor of each of the pixel circuits 100. According to some example embodiments, voltage rising speed of the source electrode S may be faster due to a current flowing in the drive transistor DM when the drive transistor DM has high mobility. Meanwhile, the mobility may represent effective mobility of a charge carrier of a transistor. In some example embodiments, the voltage rising speed of the source electrode S may be slower due to a current flowing in the drive transistor DM when the drive transistor DM has low mobility. Therefore, the voltage of the source electrode S may be $V_T+(c2/(c1+c2))\times(V_{Data}-V_{Ref})-f(\mu)$ when a voltage rising value of the source electrode S due to the current flowing in the drive transistor DM. In some example embodiments, the voltage between the gate electrode G and the source electrode S of the drive transistor DM may be $V_T+(c2/(c1+c2))\times(V_{Data}-V_{Ref})-f(\mu)$. $V_T+(c2/(c1+c2))\times(V_{Data}-V_{Ref})-f(\mu)$ may be a drive voltage compensated with respect to a threshold voltage $V_T$ difference and mobility deviation in the drive transistor DM.

Next, the second transistor M2 may be turned off as a voltage of a second scan signal [n] becomes lower and the first capacitor C1 may store the drive voltage $(V_T+(c2/(c1+c2))\times(V_{Data}-V_{Ref})-f(\mu))$ compensated with respect to a threshold voltage difference and mobility deviation in the drive transistor DM.

Figure 10:
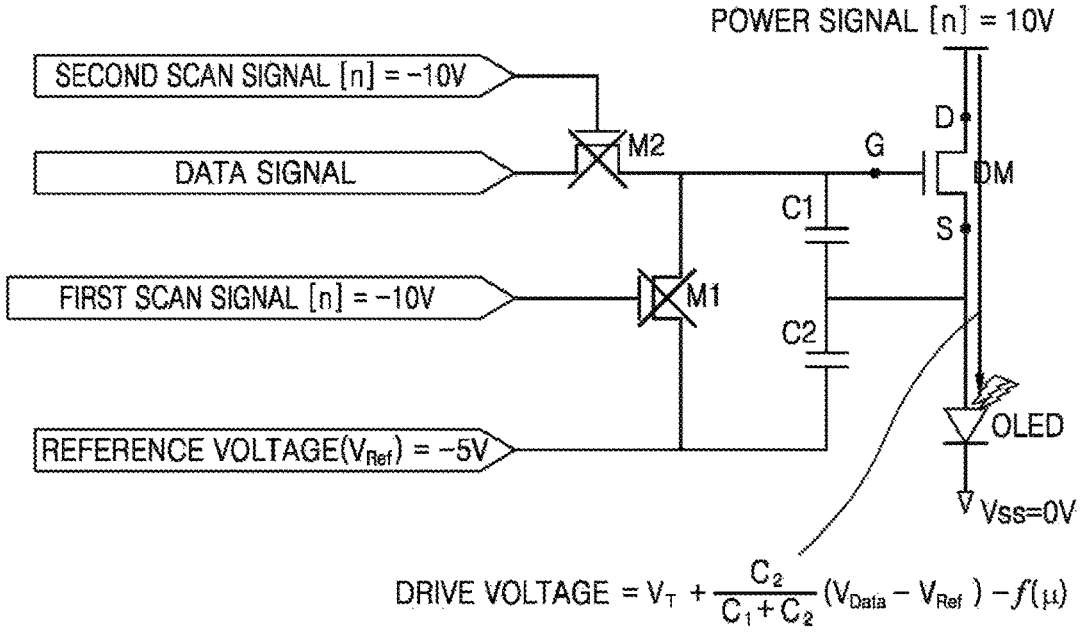
FIG. 10 is a view illustrating a pixel circuit being driven in a T5 segment of the signal waveform chart of FIG. 4.

FIG. 10 is a view illustrating the pixel circuit 300 being driven in the T5 segment of the signal waveform chart 400 of FIG. 4.

The drive transistor DM may generate a drive current corresponding to the drive voltage $(V_T+(c2/(c1+c2))\times(V_{Data}-V_{Ref})-f(\mu))$ stored in the first capacitor C1 and drive the organic light emitting diode OLED to emit light by using the generated drive current, such that the pixel circuit 300 drives the organic light emitting diode OLED to emit light by using a drive current compensated with respect to a threshold voltage difference and mobility deviation in the first capacitor C1 by using the drive voltage stored in the first capacitor C1.

According to some example embodiments, since the drive transistor DM generates a drive current based on a subtraction operation of a voltage between the gate electrode G and the source electrode S and a threshold voltage $V_T$, the drive current corresponding to the drive voltage $(VT+(c2/(c1+c2))\times(V_{Data}-V_{Ref})-f(\mu))$ may not be affected by the threshold voltage $V_T$, such that the drive current flowing in the organic light emitting diode OLED includes a current compensated with respect to a threshold voltage difference of the drive transistor DM. For example, a drive current $I_{OLED}$ may not be affected by the threshold voltage $V_T$ according to Equation 1 as below.

$$I_{OLED} = \frac{1}{2}\frac{W}{L}C_{OX}\mu(V_{GS}-V_T) = \frac{1}{2}\frac{W}{L}C_{OX}\mu\left(\frac{c2}{c1+c2}(V_{Data}-V_{Ref})-f(\mu)\right) \quad \text{[Equation 1]}$$

In Equation 1, W and L respectively represent a width and a length as a standard of a transistor, $C_{OX}$ represents a capacitance of an oxidation layer per unit area of the transistor, μ represents mobility of the transistor, and $V_{GS}$ represents a voltage between a gate electrode and a source electrode of the transistor.

In some example embodiments, a voltage rising value f(μ) of the source electrode S becomes larger when mobility of the drive transistor DM is high, and thus the drive voltage $(V_T+(c2/(c1+c2))\times(V_{Data}-V_{Ref}-f(\mu))$ becomes lower and the drive current becomes smaller. In some example embodiments, the voltage rising value f(μ) of the source electrode S becomes smaller when the mobility of the drive transistor DM is low, and thus the drive voltage $(V_T+(c2/(c1+c2))\times(V_{Data}-V_{Ref})-f(\mu))$ becomes higher and the drive current becomes larger, such that the drive current flowing in the organic light emitting diode OLED includes a current being compensated mobility deviation of the drive transistor DM.

In some example embodiments, since a drive voltage corresponding to a data signal equally transmitted to each of predetermined pixel circuits may change according to a threshold voltage difference and mobility deviation of a drive transistor of each of the predetermined pixel circuits, the organic light emitting display 10 may drive the organic light emitting diode OLED to emit light by using a drive voltage compensated with respect to the threshold voltage difference and mobility deviation in the drive transistor through one of the pixel circuits 200 or 300.

Figure 11:
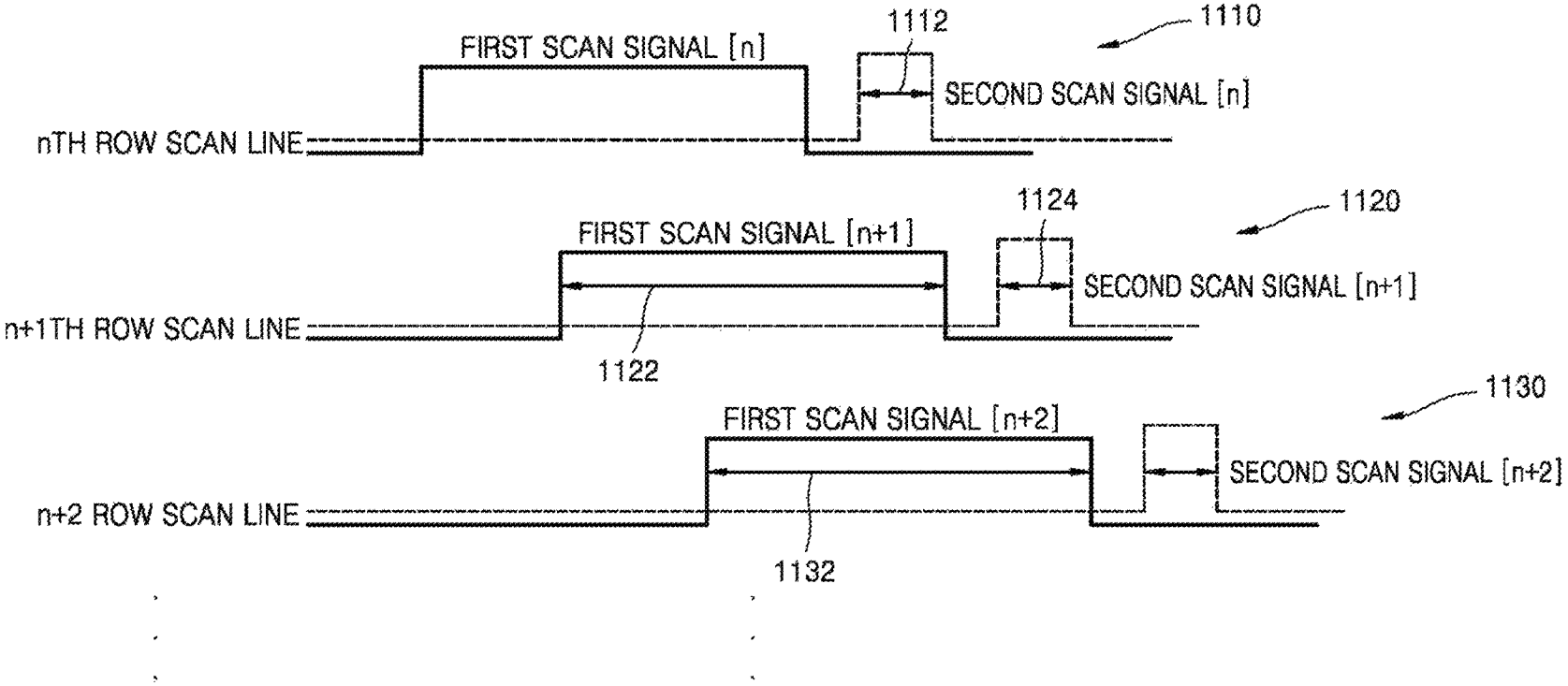
FIG. 11 is a view of scan signals transmitted to pixel circuits located in respective rows of an organic light emitting display, according to some example embodiments.

FIG. 11 is a view of scan signals transmitted to pixel circuits located in respective rows of the organic light emitting display 10 according to some example embodiments.

In some example embodiments, a signal waveform chart 1110 illustrates a first scan signal [n] and a second scan signal [n] transmitted to pixel circuits located in an nth row, such that the scan driver 110 of the organic light emitting display 10 transmits the first scan signal [n] and the second scan signal [n] to the pixel circuits located in the nth row through first and second scan lines of an nth row scan line. In some example embodiments, a signal waveform chart 1120 illustrates a first scan signal [n+1] and a second scan signal [n+1] transmitted to pixel circuits located in an n+1th row, such that the scan driver 110 of the organic light emitting display 10 transmits the first scan signal [n+1] and a second scan signal [n+1] to the pixel circuits located in the n+1th row through first and second scan lines of an n+1th row scan line. In some example embodiments, a signal waveform chart 1130 illustrates a first scan signal [n+2] and a second scan signal [n+2] transmitted to pixel circuits located in an n+2th row, such that the scan driver 110 of the organic light emitting display 10 transmits the first scan signal [n+2] and a second scan signal [n+2] to the pixel circuits located in the n+2th row through first and second scan lines of an n+2th row scan line. Although FIG. 11 illustrates three rows, it will be understood that some example embodiments include scan signals being transmitted to pixel circuits located in four or more rows.

Referring to the signal waveform charts 1110, 1120 and 1130, first time segments 1122 and 1132, during which a reference voltage is transmitted to pixel circuits located in the n+1th row and the n+2th row, respectively simultaneously progress while a second time segment 1112, during which a data signal is transmitted to pixel circuits located in the nth row, progresses, such that a threshold voltage compensation time of the pixel circuits located in the n+1th row and n+2th row may simultaneously progress while the data signal is transmitted to the pixel circuits located in the nth row. However, the pixel circuits located in the n+1th row and n+2th row are only examples, and a threshold voltage compensation time of the pixel circuits located in three or more rows may simultaneously progress while the data signal is transmitted to the pixel circuits located in the nth row.

In some example embodiments, referring to the signal waveform charts 1120 and 1130, a first time segment 1132 during which a reference voltage is transmitted to pixel circuits located in the n+2th row simultaneously progresses while a second time segment 1124 during which a data signal is transmitted to pixel circuits located in the n+1th row progresses, such that the threshold voltage compensation time of the pixel circuits located in the n+2th row simultaneously progresses while the data signal is transmitted to the pixel circuits located in the n+1th row.

Figure 12:
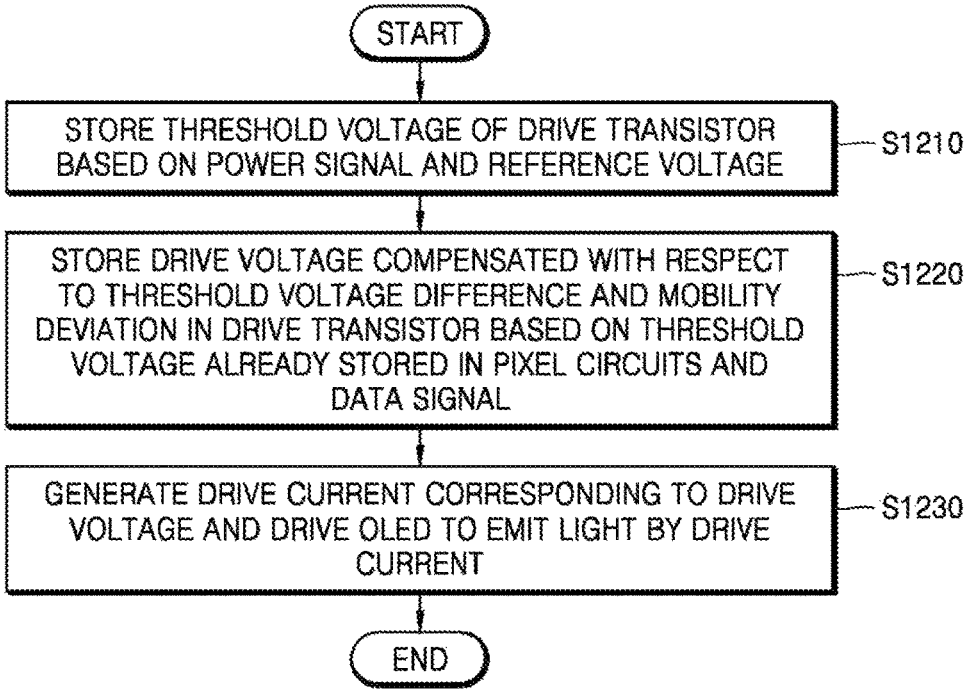
FIG. 12 is a flowchart of a driving method of a pixel circuit, according to some example embodiments.

FIG. 12 is a flowchart of a driving method of a pixel circuit, according to some example embodiments.

The driving method of FIG. 12 may be performed by the pixel circuits 200 and 300 of FIGS. 2 and 3 and thus repeated descriptions of FIGS. 2 and 3 are omitted.

In step S1210, according to some example embodiments, the pixel circuits 200 and 300 may store a threshold voltage of a drive transistor based on a power signal and a reference voltage based on a first scan signal. In some example embodiments, the pixel circuits 200 and 300 may store the threshold voltage of the drive transistor based on a voltage change of the power signal and the reference voltage transmitted during a first time segment.

In step S1220, according to some example embodiments, the pixel circuits 200 and 300 may store a drive voltage compensated with respect to a threshold voltage difference and mobility deviation in the drive transistor based on a threshold voltage already stored in the pixel circuits 200 and 300 and a data signal based on a second scan signal. In some example embodiments, the pixel circuits 200 and 300 may store the drive voltage based on the threshold voltage already stored in the pixel circuits 200 and 300 and the data signal transmitted during a second time segment. According to some example embodiments, the first time segment may be set to be longer than the second time segment.

In step S1230, according to some example embodiments, the pixel circuits 200 and 300 may generate a drive current corresponding to the drive voltage and drive an OLED to emit light by the drive current.

It will be understood that the exemplary embodiments described herein should be considered in a descriptive sense only and not for purposes of limitation. Descriptions of the features or aspects within each exemplary embodiment should typically be considered as available for other similar features or aspects in other exemplary embodiments.

While one or more embodiments have been described with reference to the figures, it will be understood by those of ordinary skill in the art that various changes in form and details may be made therein without departing from the spirit and scope as defined by the following claims.

The particular implementations shown and described herein are illustrative examples of the inventive concept and are not intended to otherwise limit the scope of the inventive concept in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device.

The use of the terms "a" and "an" and "the" and similar referents in the context of describing the inventive concept (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein may be performed in any suitable order unless otherwise indicated herein or otherwise clearly contradicted by context. The use of any and all examples, or exemplary language (e.g., "such as") provided herein, is intended merely to better illuminate the inventive concept and does not pose a limitation on the scope of the inventive concept unless otherwise claimed. Numerous modifications and adaptations will be readily apparent to those of ordinary skill in the art without departing from the spirit and scope of the inventive concept.

What is claimed is:

1. A pixel circuit of an organic light emitting display, the pixel circuit comprising:

a drive control sub-circuit configured to transmit a reference voltage to a drive transistor in response to a first scan signal, the drive control sub-circuit further configured to transmit a data signal to the drive transistor in response to a second scan signal;

a drive sub-circuit including the drive transistor, the drive sub-circuit configured to generate a drive current compensated with respect to a threshold voltage difference and mobility deviation in the drive transistor based on the reference voltage, the data signal, and a power signal; and an organic light emitting diode (OLED) configured to emit light based on the drive current, wherein the drive sub-circuit further configured to store a threshold voltage of the drive transistor, based on a voltage change of the power signal transmitted to the drive transistor and the reference voltage, store a drive voltage compensated with respect to the threshold voltage difference and mobility deviation in the drive transistor, based on the stored threshold voltage and the data signal, and generate the drive current corresponding to the drive voltage.

2. The pixel circuit of claim 1, wherein the drive control sub-circuit is configured to receive each scan signal of the first scan signal and the second scan signal through different scan lines.

3. The pixel circuit of claim 1, wherein, the drive control sub-circuit is configured to transmit the reference voltage during a first time segment, the drive control sub-circuit is configured to transmit the data signal during a second time segment, and the first time segment is set to be longer in duration than the second time segment.

4. The pixel circuit of claim 1, wherein the drive transistor includes a metal oxide thin film transistor (TFT).

5. The pixel circuit of claim 1, wherein, the drive control sub-circuit includes, a first transistor configured to transmit the reference voltage to a gate electrode of the drive transistor in response to the first scan signal, and a second transistor configured to transmit the data signal to the gate electrode of the drive transistor in response to the second scan signal;

the drive sub-circuit further includes:

a first capacitor configured to be connected between the gate electrode and a source electrode of the drive transistor, the first capacitor further configured to store the drive voltage compensated with respect to the threshold voltage difference and mobility deviation in the drive transistor, and a second capacitor connected between the source electrode and a reference voltage line, the reference voltage line configured to carry the reference voltage transmitted by the first transistor; and the drive transistor is configured to generate the drive current based on the drive voltage.

6. The pixel circuit of claim 5, wherein the first capacitor is configured to store the threshold voltage of the drive transistor based on the reference voltage and the power signal, the reference voltage transmitted by the first transistor during a first time segment.

7. The pixel circuit of claim 6, wherein, the gate electrode is configured to change voltage in response to the data signal being transmitted by the second transistor to the gate electrode, the data signal being transmitted by the second transistor during a second time segment;

the first capacitor is configured to store the drive voltage based on, the stored threshold voltage, the voltage change of the gate electrode, a voltage distribution between the first and second capacitors, and a voltage change of the source electrode due to mobility deviation in the drive transistor.

8. An organic light emitting display comprising:

a scan driver configured to provide a first scan signal to a first scan line, the scan driver further configured to provide a second scan signal to a second scan line;

a data driver configured to provide a data signal to a data line;

a power driver configured to provide a reference voltage to a reference voltage line, the power driver further configured to provide a power signal to a power line; and a plurality of pixel circuits arranged on a position where the first scan line and the data line cross, wherein each of the pixel circuits includes, a drive control sub-circuit configured to transmit the reference voltage to a drive transistor in response to the first scan signal, the drive control sub-circuit further configured to transmit the data signal to the drive transistor in response to the second scan signal;

a drive sub-circuit including the drive transistor, the drive sub-circuit configured to generate a drive current compensated with respect to a threshold voltage difference and mobility deviation in the drive transistor based on the reference voltage, the data signal, and the power signal; and an organic light emitting diode (OLED) configured to emit light based on to the drive current, wherein the drive sub-circuit further configured to:

store a threshold voltage of the drive transistor, based on a voltage change of the power signal transmitted to the drive transistor and the reference voltage, store a drive voltage compensated with respect to the threshold voltage difference and mobility deviation in the drive transistor, based on the stored threshold voltage and the data signal, and generate the drive current corresponding to the drive voltage.

9. The organic light emitting display of claim 8, wherein, the drive control sub-circuit is configured to transmit the reference voltage during a first time segment, the drive control sub-circuit is configured to transmit the data signal during a second time segment, and the first time segment is set to be longer in duration than the second time segment.

10. The organic light emitting display of claim 8, wherein the drive transistor includes a metal oxide TFT.

11. The organic light emitting display of claim 8, wherein, the plurality of pixel circuits includes a first pixel circuit and a second pixel circuit, the first pixel circuit and the second pixel circuit located in respective rows of pixel circuits;

the scan driver is configured to transmit the first scan signal to the first pixel circuit, such that a drive control sub-circuit included in the first pixel circuit transmits the reference voltage to a drive transistor included in the first pixel circuit, during a first time segment;

the scan driver is further configured to transmit the second scan signal to the second pixel circuit, such that a drive control sub-circuit included in the second pixel circuit transmits the data signal to a drive transistor included in the second pixel circuit, during a second time segment; and the first time segment and the second time segment progress at least partially concurrently.

12. The organic light emitting display of claim 8, wherein the drive control sub-circuit includes, a first transistor configured to transmit the reference voltage to a gate electrode of the drive transistor in response to the first scan signal, a second transistor configured to transmit the data signal to the gate electrode of the drive transistor in response to the second scan signal;

the drive sub-circuit further includes:

a first capacitor configured to be connected between the gate electrode and a source electrode of the drive transistor, the first capacitor further configured to store the drive voltage compensated with respect to the threshold voltage difference and mobility deviation in the drive transistor, and a second capacitor connected between the source electrode and the reference voltage line, the reference voltage line configured to carry the reference voltage transmitted by the first transistor; and the drive transistor is configured to generate the drive current based on the drive voltage.

13. A method of driving a pixel circuit, the method comprising:

storing a threshold voltage of a drive transistor, based on a power signal transmitted to the drive transistor and a reference voltage transmitted to the drive transistor, the reference voltage transmitted in response to a first scan signal;

storing a drive voltage compensated with respect to a threshold voltage difference and mobility deviation in the drive transistor, based on the stored threshold voltage and a data signal transmitted to the drive transistor, the data signal transmitted in response to a second scan signal; and generating a drive current to cause an organic light emitting diode (OLED) to emit light through the drive current, the drive current corresponding to the drive voltage, wherein the storing the threshold voltage includes storing the threshold voltage of the drive transistor based on a voltage change of the power signal and the reference voltage, and the storing the drive voltage includes storing the drive voltage based on the stored threshold voltage and the data signal.

14. The method of claim 13, wherein each scan signal of the first scan signal and the second scan signal is received through different scan lines.

15. The method of claim 13, wherein, the reference voltage is transmitted during a first time segment, the data signal is transmitted during a second time segment, and the first time segment is longer in duration than the second time segment.

16. The method of claim 13, wherein the drive transistor includes a metal oxide TFT.

* * * * *